US005416400A

United States Patent [19]

St. Louis

[11] Patent Number: 5,416,400

[45] Date of Patent: May 16, 1995

[54] GAS DRYER CONVERSION CIRCUIT

[76] Inventor: Robert M. St. Louis, 8980 Rochette, St. Leonard, Quebec, Canada

[21] Appl. No.: 15,104

[22] Filed: Feb. 9, 1993

[30] Foreign Application Priority Data

Feb. 13, 1992 [CA] Canada ..... 2061172

[51] Int. Cl.[6] ..... H028 1/00

[52] U.S. Cl. ..... 318/781; 34/572

[58] Field of Search ..... 318/778, 779, 781, 783, 318/784, 785, 789, 793; 110/191; 361/156; 34/445, 497, 527, 533, 551, 539, 547, 572

[56] References Cited

U.S. PATENT DOCUMENTS 3,558,110 1/1971 Kushner ..... 34/45
3,647,196 3/1972 Cotton ..... 34/45
3,959,697 5/1976 Bauer et al. ..... 361/156
4,036,152 7/1977 Bright ..... 110/191
4,226,026 10/1980 Deming et al. ..... 34/45 X
4,312,138 1/1982 Ellington ..... 34/45 X
4,506,458 3/1985 Cochrane ..... 34/48
4,663,861 5/1987 Scriber ..... 34/56

*Primary Examiner*—Jonathan Wysocki

[57] ABSTRACT

This invention relates to a circuit for energizing a device in a domestic clothes dryer from a source of potential which if directly connected across the device would lead to premature failure of the device. In order to drop the potential applied to the device, the start winding of the drive motor is serially connected in the circuit containing the device to drop the potential applied to the device.

7 Claims, 5 Drawing Sheets

GAS DRYER CONVERSION CIRCUIT

BACKGROUND OF THE INVENTION

Gas dryers produced for sale in the North American Market are usually constructed to operate at a supply voltage of 115–130 volts. The dryer is connected to the electrical supply in order to provide energy to monitor the operation of the dryer, and to operate the timer motor, the gas valve mechanism, the ignition device and the drive motor which turns the drum and drives a blower. Electricity may be used to supply backlighting for the controls as well as illumination in the drum.

When it is desired to construct a gas dryer for foreign markets it will generally be found that in other countries the supply voltage will be in the range of 220–240 volts and that substantial modifications must be made to the standard 120 volt domestic gas dryer in order to have the dryer function at this increased supply voltage level.

The drive motor which turns the drum and blows the air through the dryer during drying periods is usually a standard single phase type using a split-phase scheme to start the motor by methods well known to those skilled in the art.

Drive motors which operate at either of the above voltages are readily available from manufactures thus the drive function is easily converted to the higher voltage. Bulbs and indicating lamps are also readily available for use at the higher mains voltage.

Gas valves and gas igniters which will operate at the higher supply voltage are readily available in countries foreign to North America, but the cost of such modifications which are necessitated by the incorporation of such gas valves and igniters of the higher voltage ratings is great enough to deter a North American manufacturer from using them.

Thus, the standard practice for manufacturers of dryers in North America, in producing clothes dryers for markets which require the higher voltage rating in the past, is to use a step down transformer to lower the voltage applied to the igniter and gas valve in order to provide for operation of a 120 volt dryer at 240 volts. Because the standard ignition device consumes large wattage, it is necessary that the conversion transformer have a substantial KVA rating, thus increasing the cost of conversion of the dryer from the lower voltage level to the higher voltage level.

SUMMARY OF THE INVENTION

This invention seeks to keep the cost of conversion to a minimum by omitting the conversion transformer completely and using the start winding of the dryer motor as a convenient high wattage voltage dropping device in series with the ignition device. Standard resistors of a low wattage rating are then utilized in series with the coils of the solenoid gas valve to drop the voltage applied thereto.

BRIEF DESCRIPTION OF THE DRAWINGS

Referring now to the drawings.

DESCRIPTION OF THE PREFERRED EMBODIMENTS

Figure 1:
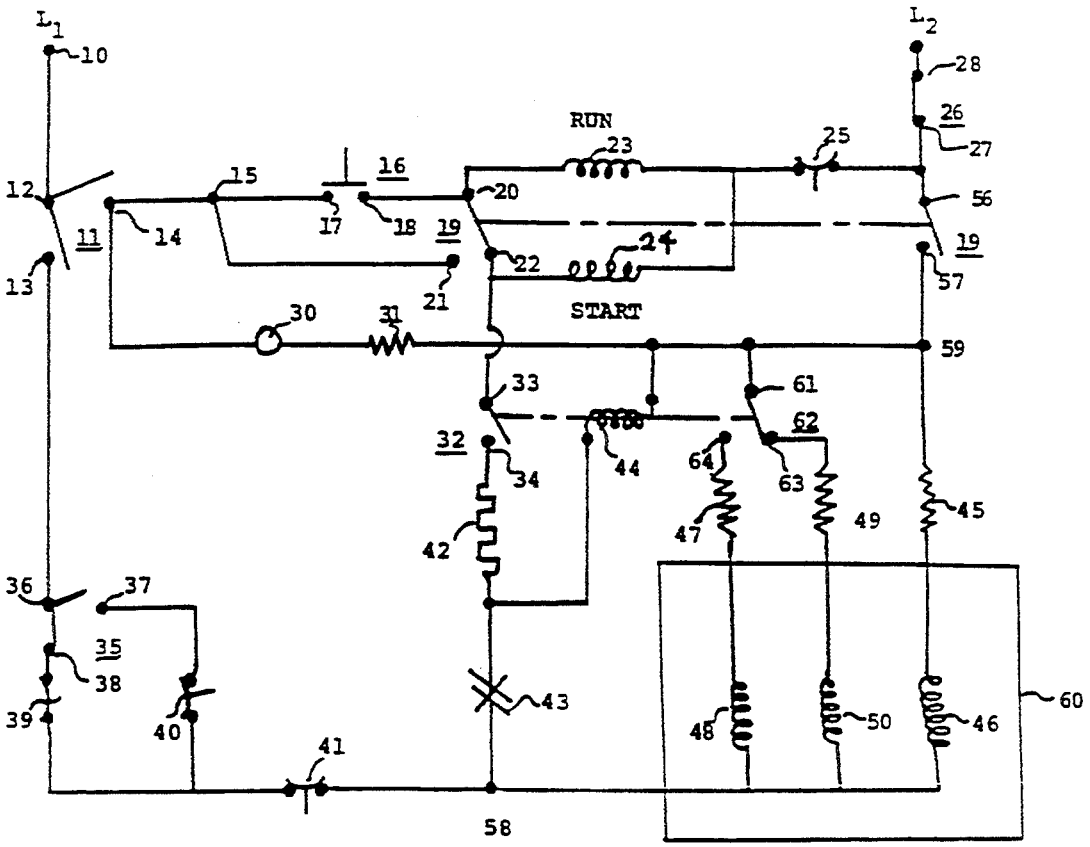
FIG. 1 is a schematic of the dryer control circuit employed for dryer operation showing its condition in the "off" state.
Figure 5:
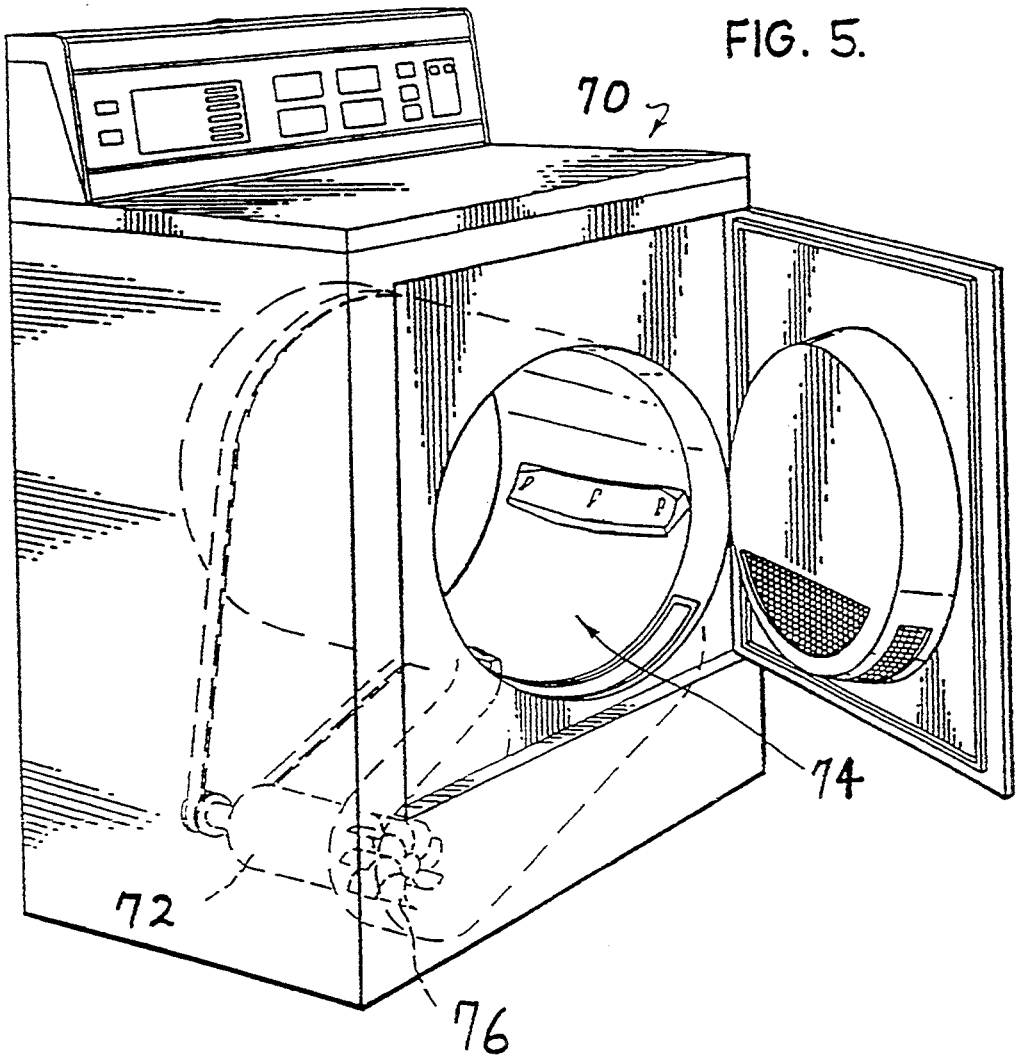
FIG. 5 is a perspective view of the gas clothes dryer for which the dryer control circuit of the present invention controls.

Referring now to FIG. 1 and FIG. 5, terminal 10 is connected to $L_1$, one side of the electrical source, which in this instance is 220–240 volts. Terminal 10 is connected to timer switch 11 at terminal 12, the movable contacts of which are connected to terminals 13 and 14 and which are free to move independently of each other during operation of the dryer. Terminal 14 is connected to terminal 15 which is connected to terminal 17 of momentary start switch 16 and terminal 21 of the drive motor centrifugal switch 19. Start switch serves to bridge the contacts 17 and 18 when momentarily depressed by the operator during initial startup of the gas clothes dryer 70 (FIG. 5). Terminal 18 is connected to terminal 20 of the centrifugal motor switch which is also connected to the main motor winding 23 of the dryer drive motor. This 72 (FIG.5) motor serves to drive the clothes drum 74 (FIG.5) of the dryer as well as to drive the fan or blower 76 (FIG.5) which circulates the air through the dryer 70 during drying operations. In this instance the motor will be of the split phase type, single phase motor of a rating of 220–240 volts. Winding 23 is also connected to the motor temperature protection switch 25.

Centrifugal switch 19 has a third terminal 22 which is connected to start winding 24. During startup terminals 20 and 22 are connected as shown in FIG. 1. Terminal 22 is connected to start winding 24 of the dryer motor. The start winding 24 is also connected to motor temperature protection switch 25. Switch 25 is also connected to door switch 26 at terminal 27 and to terminal 56 which is part of a second contact assembly of centrifugal switch 19. Contact 56 is connected to contact 57 when the dryer drive motor 72 reaches rated speed. Terminal 28 of door switch 26 is connected to line terminal 29 which is connected to $L_2$ the other side of the 220–240 volt supply.

Terminal 14 is connected to timer motor 30 and to voltage dropping resistor 31 which is connected to terminal 57 of centrifugal motor switch 19.

Terminal 13 of timer switch 11 is connected to terminal 36 of temperature selection switch 35. Terminal 38 of switch 35 is connected to high temperature thermostat 39 which is located in such location so as to sense the outlet temperature of air leaving the dryer 70, and terminal 37 is connected to low temperature thermostat 40 which also senses outlet temperature of air leaving the dryer 70. Both thermostats 39 and 40 are connected to high temperature inlet thermostat 41. The operator chooses which of the thermostats 39 or 40 will be in control during the drying operation and in this instance the thermostat 39 (high temperature) is in control.

Centrifugal switch terminal 22 is connected to terminal 33 of relay switch 32 which is connected to terminal 34 of relay 32 when the coil 44 of the relay is energized. Terminal 34 of relay 32 is connected to igniter 42 which is connected to detector 43.

Detector 43 is connected to terminal 58 which is connected to thermostat 41 and safety holding coil 46, main coil 48 and safety booster coil 50 of solenoid gas control valve 60.

Relay coil 44 is connected to the junction of detector 43 and igniter 42, and the opposite end of relay coil 44 is connected to terminal 59.

Safety holding coil 46 is connected via resistor 45 to terminal 59 as is terminal 61 of relay switch 62. Relay switch 62 has two other contacts 63 and 64 such that terminals 61 and 63 are normally connected when the relay coil 44 is not energized. Terminal 63 is connected via resistor 49 to the main coil 50 of gas valve 60, the other end of coil 50 is connected to terminal 58. Similarly terminal 64 of relay switch 62 is connected via resistor 47 to safety booster coil 48, which has its other end connected to terminal 58.

FIG. 1 shows the control circuit in the "off" condition.

Figure 2:
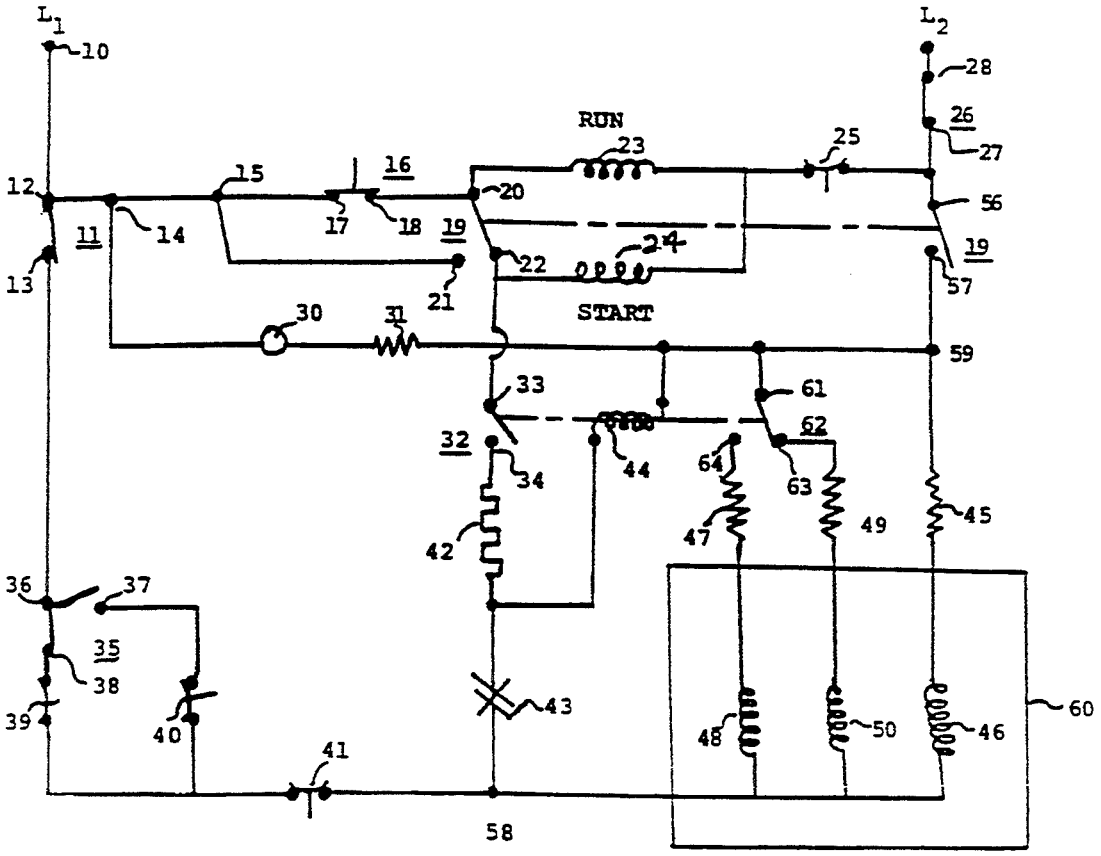
FIG. 2 is a schematic of the dryer control circuit in the momentary "start" state, and, FIG. 3 is a schematic of the dryer control circuit during periods when the igniter is energized.
Figure 3:
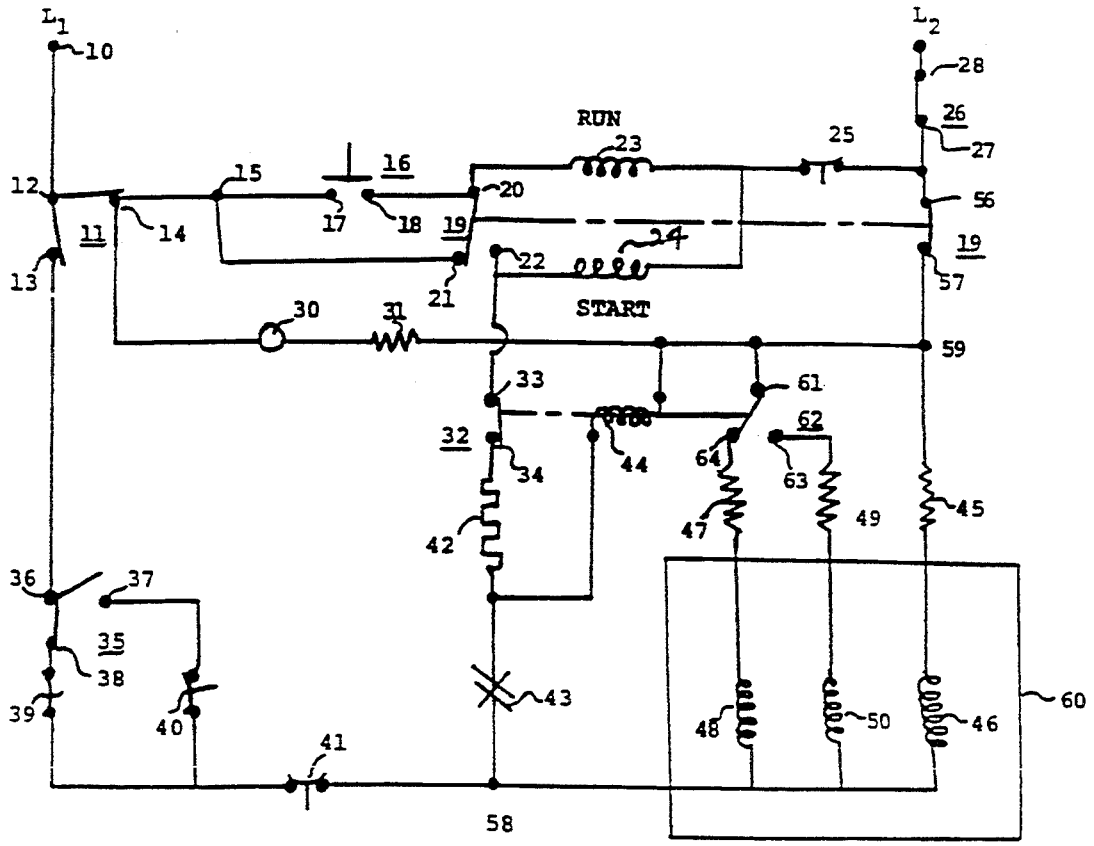
Figure 4:
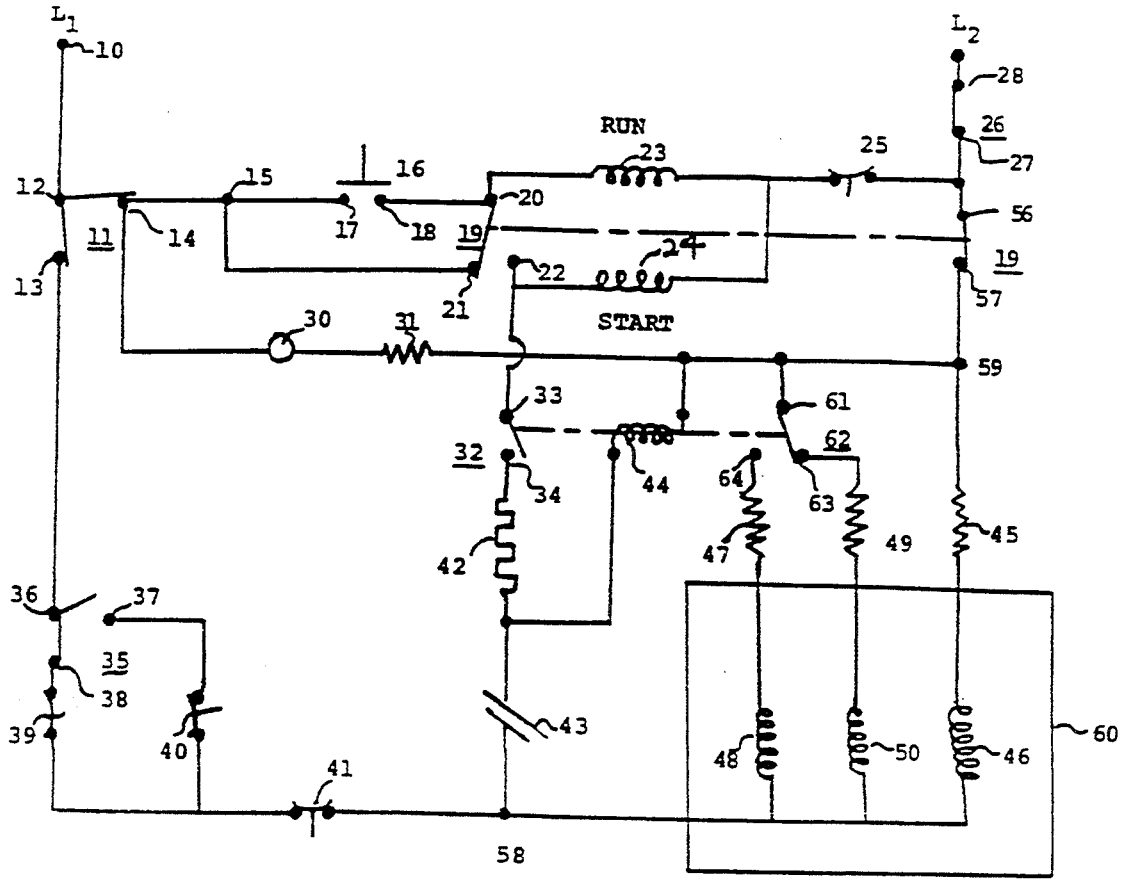
FIG. 4 is a schematic of the dryer control circuit which includes the normal operation of the dryer after gas ignition.

The timer switch 11 must be set by the operator to choose the length of time the drying operation will continue, and setting the timing switch, the contacts of which are 12, 13 and 14, will hold the circuit in readiness for the activation of start button 16. FIG. 2 shows the control circuit in the momentary "START" state, i.e. timer switch 11 set and start switch 16 shown with contact 17 and 18 bridged. During this time the main drive motor will begin to rotate until the rotational velocity will be sufficient to cause centrifugal switch 19 to operate to open contacts 20 and 22 and close contacts 20 and 21 while simultaneously causing contacts 56 and 57 to become closed. This means that run winding 23 is now energized via the bridging of contacts 20 and 21 and the closing of the contacts 56 and 57 of centrifugal switch 19 energizes timer motor 30 (see FIG. 3).

Relay coil 44 is now energized by the closure of contacts 56 and 57 and this results in the closing of contacts 33 and 34 of switch 32 as well as contacts 61 and 64 of switch 62. The closure of switch 32 results in the energization of igniter 42 via switch 32; start winding 24, overload thermostat 25, door switch 26, thermostat 41, thermostat 39, switch 35, and switch 11.

The closing of relay contacts 61 and 64 energizes safety booster coil 48 which in cooperation with safety holding coil which is also energized through contacts 56 and 57 being closed, causes the safety valve on solenoid valve 60 to open.

When igniter 42 begins to glow, the radiant energy from igniter 42 is detected by detector 43 which opens thus deenergizing igniter 42 and relay coil 44. This causes contacts 33 and 34 to open, contacts 61 and 64 to open and contacts 61 and 63 to close. Main solenoid coil 50 is now energized and at this point gas is admitted to the burner thus keeping detector 43 open. The glowing igniter 42 ignites the gas admitted to the burner, the burning gas keeps the detector 43 open.

The supply of gas to the burner continues to flow such that detector 43 remains open and drying continues until high temperature thermostat 39 opens when the drying air temperature has increased to the switching point of the thermostat 30. The moisture content of the clothes has now decreased sufficiently that the exit temperature of the drying air must increase. This immediately deenergizes coils 46, 48 and 50 of solenoid valve 60 and the valve shuts off discontinuing the supply of gas to the burner.

The dryer continues to operate with no additional heat to the air stream passing through the drum. Detector 43 will close due to the lack of radiant energy and when the clothes in the drum have cooled sufficiently, thermostat 39 again closes, reenergizing coil 44 of the relay. The circuit reverts back to that shown in FIG. 3 and the startup process begins again.

It will be seen that the igniter is now energized by a circuit which always includes the start winding of the main drive motor. It will be found that for a period of from about 5 to 30 seconds the start winding must dissipate about 400 watts of energy for a typical igniter. In most instances a standard 240 volt motor will be able to readily dissipate this energy without problems of overheating or the tripping of thermal protection switch such as the one shown in the drawings as 25.

The igniter 42 of this application is resistive device manufactured from a material such as carborundum which will conduct electricity and have sufficient resistivity to glow over a fairly wide range of applied voltages, i.e. 120–180 volts. If a potential of 220–250 volts is applied to such igniters, the igniter will fail very quickly due to overheating.

It will surely appear obvious to those skilled in the art that there are numerous ways of connecting the circuitry to provide a series relationship between the igniter and the start winding but these are deemed to be obvious once the circuit of this invention has been described.

I claim:

1. An electrical control circuit for energization of an ignition circuit of a gas clothes dryer having a motor adapted to rotate a dryer drum, comprising:

(a) source of electrical energy of about 230 volts;

(b) an igniter rated for operation at a nominal voltage of about 115 volts; and (c) a start winding of said motor rated for operation at about 230 volts, said igniter and said start winding of said motor being connected in a series relationship across said source during periods of energization of said igniter by said control circuit.

2. In a gas dryer for drying clothes having a driving motor with a start winding and a run winding adapted to operate at a predetermined voltage rating, an electrical control circuit for energizing an igniter of the gas-air stream used to heat the air which passes through the dryer to dry clothes therein, said igniter having a voltage rating substantially less than the predetermined voltage rating, said igniter being connected in a series relationship with the start winding of the driving motor to reduce the voltage applied to said igniter during periods when the control circuit activates said igniter.

3. A method of using an electrical igniter in a gas clothes dryer which uses a single phase electric motor having a run winding and a start winding to drive a blower and rotate a clothes drum of said dryer, the method comprising the steps of:

(a) supplying to the dryer a supply voltage of about double the voltage rating of the igniter, (b) switching the start winding and the igniter in series relationship across the supply voltage during periods when the ignitor is activated wherein the igniter is energized in a circuit which also includes the start winding of the motor, so as to divide the supply voltage between the start winding and the igniter during such activation periods when the only the run winding is connected directly across the supply voltage.

4. The method of claim 3 wherein the switching step occurs after the motor reaches a predetermined rotating speed.

5. The method of claim 4 wherein prior to the motor reaching the predetermined rotating speed, the step occurs of energizing both the start winding and run winding of the motor by connecting these windings in parallel directly across the voltage source and inhibiting current flow through the igniter until the motor reaches the predetermined rotating speed.

6. In the gas dryer of claim 2, the electrical control circuit further including a centrifugal switch and a solenoid switch for connecting the start winding in series with the igniter, the centrifugal switch adapted to initially connect the start winding and run winding of the motor in circuit during start up operation of the dryer motor and to open circuit a current path through a relay coil of the solenoid switch, once the dryer motor reaches a predetermined speed of rotation the centrifugal switch disconnects the start winding of the drive motor and closes the circuit path through the relay coil of the solenoid to energize the relay coil and to cause the solenoid switch to close and connect the start winding in series with the igniter.

7. In the gas dryer of claim 6, the electrical control circuit further including an igniter detector connected in series with the igniter and the relay coil, the igniter detector detecting when the igniter begins to glow and open circuiting to cause gas to flow to the igniter.

* * * * *